US011598035B2

(12) United States Patent
Wagner et al.

(10) Patent No.: US 11,598,035 B2
(45) Date of Patent: Mar. 7, 2023

(54) METHOD AND APPARATUS FOR MAKING A NONWOVEN FROM CONTINUOUS FILAMENTS

(71) Applicants: Tobias Wagner, Cologne (DE); Dirk Buettner, Troisdorf (DE); Alexander Klein, Troisdorf (DE)

(72) Inventors: Tobias Wagner, Cologne (DE); Dirk Buettner, Troisdorf (DE); Alexander Klein, Troisdorf (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 0 days.

(21) Appl. No.: 17/530,509

(22) Filed: Nov. 19, 2021

(65) Prior Publication Data

US 2022/0154375 A1 May 19, 2022

(30) Foreign Application Priority Data

Nov. 19, 2020 (DE) ..... 102020130593.1
Nov. 19, 2020 (EP) ..... 20208671

(51) Int. Cl.

| | |
|---|---|
| ***D01D 4/02*** | (2006.01) |
| ***D01D 5/088*** | (2006.01) |
| ***D01D 7/00*** | (2006.01) |
| ***D01D 13/00*** | (2006.01) |
| ***D01D 13/02*** | (2006.01) |
| ***D04H 3/02*** | (2006.01) |
| ***D04H 3/033*** | (2012.01) |

(52) U.S. Cl.
CPC ..... *D04H 3/033* (2013.01)

(58) Field of Classification Search
CPC ..... D01D 4/02; D01D 5/088; D01D 7/00; D01D 13/00; D01D 13/02; D04H 3/02; D04H 3/033
USPC ..... 264/103, 211.12, 211.14, 555; 425/72.2, 425/363, 377, 378.2, 382.2, 464
See application file for complete search history.

(56) References Cited

U.S. PATENT DOCUMENTS 5,807,795 A 9/1998 Lau

FOREIGN PATENT DOCUMENTS

WO 2000046434 A 8/2000

*Primary Examiner* — Leo B Tentoni
(74) *Attorney, Agent, or Firm* — Andrew Wilford

(57) ABSTRACT

An apparatus for making nonwoven from continuous filaments has a spinner for spinning the filaments, a cooler for cooling the spun filaments, and a mesh belt that moves in a generally horizontal travel direction and that passes through a deposition location where the spun and cooled filaments are deposited on the mesh belt to form thereon a nonwoven web. A nose roller defines a deflection zone over which the mesh belt is deflected from its travel direction downstream of the deposition location. At least one lift roller above the mesh belt downstream of the deposition location separates the nonwoven web from the mesh belt at a separation location at a first spacing upstream from the deflection zone of the nose roller. A treatment device for the nonwoven web is provided downstream of the mesh belt in the travel direction and receiving the nonwoven web from the lift roller.

17 Claims, 2 Drawing Sheets

METHOD AND APPARATUS FOR MAKING A NONWOVEN FROM CONTINUOUS FILAMENTS

FIELD OF THE INVENTION

The present invention relates to making a spunbond from continuous filaments. More particularly this invention concerns both a method and apparatus for making a nonwoven web.

BACKGROUND OF THE INVENTION

An apparatus for making from continuous filaments typically comprises a spinner for spinning the filaments and a cooler for cooling of the filaments, furthermore a mesh belt is provided on a deposition location of which the filaments can be deposited to form a nonwoven web, a nose roller deflects the mesh belt at a deflection zone from its travel direction and at least one downstream treatment device for the nonwoven web is available downstream of the mesh belt of the nonwoven web in the travel direction. The invention further relates to a method of transporting and treating a nonwoven web made of continuous filaments. Continuous filaments differ due to their practically endless length from staple fibers that are significantly shorter in length, for example 10 mm to 60 mm.

Systems of the above-mentioned type are known in different designs from practice. In the apparatus, the filaments are spun by a spinner, then cooled in a cooler and finally deposited on a screen-type conveyor belt to form the nonwoven web. The prior-art mesh belt is usually an endless revolving foraminous belt that is deflected by a nose roller in a deflection zone from its travel direction. The nonwoven web is transferred from the mesh belt at a deflection zone at the end of the mesh belt from the mesh belt at this nose roller to a downstream treatment device and is thus separated in the deflection zone from the mesh belt. The known apparatuses and methods however have shown that separation of the nonwoven web from the mesh belt requires a relatively high force, and in this respect is not always simple and functionally reliable. In addition, a usually sufficiently good adhesion of the nonwoven web to the mesh belt is desirable at least in the deposition location, so that there, as it were, there is a tradeoff between easy separation from the belt and good adherence to it. In addition, the strong deflection of the mesh belt in the deflection zone leads to jamming or pinching of the endless filaments in the mesh belt. The result is that high force is used for the separation of the nonwoven web from the mesh belt that can damage the nonwoven web by tearing out filaments. Filament scraps can remain on the mesh belt in an undesired manner during the separation step from the nonwoven web be torn out. In this respect there is a need for improvement.

OBJECTS OF THE INVENTION

It is therefore an object of the present invention to provide an improved method and apparatus for making nonwoven from continuous filament.

Another object is the provision of such an improved method and apparatus for making nonwoven from continuous filament that overcomes the above-given disadvantages, in particular that reliably separates the nonwoven web easily and functionally from the mesh belt so as in particular to avoid damage to the nonwoven web during the separating process and that reduces the force necessary for separating the nonwoven web from the mesh belt.

SUMMARY OF THE INVENTION

An apparatus for making nonwoven from continuous filaments. The apparatus has according to the invention a spinner for spinning the filaments, a cooler for cooling the spun filaments, and a mesh belt that moves in a generally horizontal travel direction and that passes through a deposition location where the spun and cooled filaments are deposited on the mesh belt to form thereon a nonwoven web. A nose roller defines a deflection zone over which the mesh belt is deflected from its travel direction downstream of the deposition location. At least one lift roller above the mesh belt downstream of the deposition location separates the nonwoven web from the mesh belt at a separation location at a first spacing upstream from the deflection zone of the nose roller. A treatment device for the nonwoven web is provided downstream of the mesh belt in the travel direction and receiving the nonwoven web from the lift roller.

The spinner according to the invention is within the scope of the invention especially a spinneret. The travel direction of the mesh belt is in the context of the invention in particular a direction in which the mesh belt or the endless circulating mesh belt moves for conveying the nonwoven web. The travel direction of the nonwoven web is in particular the travel direction of the mesh belt. The deflection zone is in the context of the invention in particular the area at the end of the mesh belt where the mesh belt passes over the nose roller and is deflected from its travel direction. The separation area or location is in the context of the invention an area where the nonwoven web separates from the mesh belt. According to a preferred embodiment the separation location is a separation line extending in particular transversely, preferably perpendicular, to the travel direction of the mesh belt. The separation location or the separation line is preferably in the travel direction of the mesh belt upstream of the deflection zone and/or upstream of the nose roller. The first spacing is particularly between a projection of the axis of rotation of the nose roller on the mesh belt and the separation zone or line, the projection of the axis of rotation being perpendicular to the longitudinal extension of the mesh belt in the area of the first spacing. The longitudinal extension of the mesh belt is in the context of this invention parallel to the travel direction. The deposition location appropriately is that area of the mesh belt where the spun filaments are deposited to form the nonwoven web. Here and below, in particular, the use position is the operating state of the apparatus when running so long as nothing else is stated.

According to a preferred embodiment of the invention, the apparatus according to the invention is a spunbond apparatus, and a stretcher for stretching the filaments is provided. Another embodiment of the invention is characterized in that the apparatus according to the invention is a melt-blown apparatus.

The apparatus according to the invention is more preferably a spunbond apparatus making spunbond nonwoven or manufactured nonwoven webs. The endless filaments are monocomponent filaments and/or multicomponent filaments or bicomponent filaments. The multicomponent filaments or bicomponent filaments can be for example endless filaments with core-sheath configuration or a side-by-side configuration. The multicomponent filaments or bicomponent filaments have a tendency to curl. According to a preferred embodiment of the invention the multicomponent continuous filaments made by the apparatus according to the invention are made of at least one thermoplastic material, in particular from at least one polyolefin, preferably from polypropylene and/or polyethylene. According to another preferred embodiment the at least one thermoplastic resin is a polyester or copolyester, in particular polyethylene terephthalate and/or a polyethylene terephthalate copolymer.

According to the invention there is a cooler for cooling the filaments. The cooler preferably has a cooling chamber through which the continuous filaments pass for cooling. It is preferred that on two opposite sides the cooling chamber there are air-supply compartments for the feeding in cooling air. According to a preferred embodiment, the air-supply compartments are provided on two opposite sides of the cooling chamber one above the other, in particular two stacked air-supply compartments from which air of different temperatures is preferably introduced into the cooling chamber. Also a monomer aspirator or suction device is provided between the spinner and the cooler for extracting the noxious gases that occur during the spinning process from the apparatus or the spunbond apparatus. The noxious gases can be, for example, monomers, oligomers, and the like.

Downstream of the cooler in the filament-travel direction is a stretcher for stretching the filaments. According to a specially recommended embodiment of the apparatus according to the invention, a subassembly consisting of the cooler and the stretcher is a closed subassembly, in which apart from the supply the cooling air to the cooler no further air is supplied to the closed subassembly.

It is preferred that between the stretcher and the mesh belt there is at least one diffuser. The endless filaments emerging from the stretcher are pass downward through the diffuser and then are deposited on the mesh belt, in particular in the deposition location of the mesh belt. According to one embodiment of the invention, there are two downstream diffusers. The mesh belt or the endlessly rotating mesh belt is air permeable so that process air can be extracted from below through the mesh belt. Advantageously, at least one aspirator draws process air in the deposition location of the mesh belt from below down through the mesh belt.

A preferred embodiment of the invention is thereby characterized in that the at least one lift roller is so oriented relative to the nose roller that the separation location lies in the travel direction of the mesh belt upstream of the deflection zone. It is recommended that the lift roller is spaced in the travel direction of the mesh belt downstream of the nose roller. It is within the scope of the invention that the nonwoven web pass over the at least one lift roller. It is best for the least one lift roller to be a nonsuction lift roller.

According to a particularly preferred embodiment of the invention, the first spacing is smaller than a second spacing between the nose roller and a deflection roller. The deflection roller in this context is in particular a roller in addition to the nose roller for transporting the mesh belt and is upstream of the nose roller in the travel direction of the mesh belt. The upstream lift roller is in particular between the deposition location and the deflection zone. This can be done without deflection from its travel direction. According to one preferred embodiment the mesh belt is deflected by the deflection roller from its travel direction, as will be explained in more detail below. It is preferred that there is at least one nose roller in the travel direction of the mesh belt or in the travel direction of the nonwoven web downstream of the deposition location and downstream of the subassembly from the spinner and cooler. Appropriately the at least one deflection roller is in the travel direction of the mesh belt or in the travel direction of the nonwoven web downstream of the deposition location or downstream of the unit spinner and cooler, but upstream of the nose roller. The second spacing between the nose roller and the deflection roller is in the context of the invention in particular the spacing between the axes of rotation of the nose roller and the deflection roller, which is advantageously measured between the projections of the axes of rotation on the mesh belt, the projections of the axes of rotation being perpendicular to the longitudinal extension of the mesh belt in the area of the second spacing.

Advantageously, the area between the deflection roller and the nose roller forms a transfer table whose length is defined by the second spacing. The transfer table has Advantageously the essential function of transferring the nonwoven web from the mesh belt to the downstream treatment device.

It is preferred that the first spacing be a maximum of 50%, preferably a maximum of 25%, preferably a maximum of 10%, particularly preferably a maximum 5%, very particularly preferably a maximum of 2.5%, for example 1% of the second spacing. According to another preferred embodiment of the apparatus according to the invention, this first spacing is at least 25% of a diameter n of the nose roller 7, preferably at least 50%, preferably at least 75%, especially preferably at least 100% and very particularly preferably at least 125% of the diameter n of the nose roller. More preferably the first spacing is between 10% and 500%, particularly preferred between 25% and 400%, very particularly preferably between 50% and 350% of the diameter n of the nose roller.

It is within the scope of the invention that the at least one lift roller is adjustable vertically relative to the mesh belt and is preferably movable vertically for this purpose. The lift roller can as a result of its height adjustability or vertical displaceability move back and forth between a starting position and a plurality of different lift positions. In the starting position of the lift roller one can, for example, clean the apparatus or thread in a new nonwoven web workpiece. In this condition, the apparatus cannot run. In the lift position the lift roller is positioned relative to the nose roller in such a way that when the apparatus is running, the first spacing is defined between the separation location or the separation line of the nonwoven web and the nose roll.

A preferred embodiment of the invention is thereby characterized in that the at least one lift roller is a rotating lift roller, in particular a driven lift roller. Basically it is also the within the scope of the invention that the lift roller be a simple round profile that does not rotate and is not designed to be driven. Such a round profile has instead of an axis of rotation, a longitudinal axis. It is preferred that the lift roller be rotatable.

Another preferred embodiment of the invention device is characterized in that the at least one lift roller of offset from the mesh belt by a third spacing that advantageously is greater than 50% of the lift-roller diameter is and preferably at least 55%, especially preferably at least 60% of the lift-roller diameter of the lift roller. The third spacing is in the context of the invention in particular the spacing of the axis of rotation of the at least one lift roller to the mesh belt, this third spacing advantageously being measured perpendicular to the longitudinal extension of the mesh belt in the area of the at least one lift roller or to the imaginary extension of this longitudinal extension.

It is recommended that the lift-roller diameter be 10 to 500 mm, preferably 25 to 400 mm, preferred 50 to 300 mm, particularly preferably 100 to 250 mm. The lift-roller diameter is advantageously smaller than eight times the diameter n the nose roller.

An embodiment that is very special to the scope of the invention is that at least two, in particular just two lift rollers are provided, including a second lift roller preferably set or positionable upstream in the travel direction of the mesh belt of the nose roller and the first lift roller preferably set or positionable along the travel direction of the mesh belt between the second lift roller and the nose roller or downstream of the nose roller.

It is preferred that the at least two, in particular the exactly two lift rollers are designed to rotate. According to one embodiment the at least two, in particular the just two lift rollers are rotatably driven lift rollers. It is also within the scope of the invention that the first lift roller and the second lift roller are the of same diameter or essentially the same diameter. But it is also possible that the first and the second lift rollers have different respective diameters. Appropriately, the lift-roller diameters then each are between 10 and 500 mm, preferably between 25 and 400 mm, preferably between 50 and 300 mm, and particularly preferred between 100 and 250 mm. Preferably the spacing m between the axes of rotation of the two lift rollers is at least 105%, preferably at least 110%, particularly preferably at least 115% of the lift-roller diameter. When the two lift rollers have different diameters, this information relates to the diameter of the lift roller with the larger diameter. The spacing of the rotation axes is measured advantageously between projections of the axes of rotation of the lift rollers on the mesh belt, the projections of the axes of rotation being perpendicular to the longitudinal extension of the mesh belt in the area of the lift rollers. It is preferred that a spacing m of the axes of rotation of the two lift rollers be less than 300%, preferably less than 250%, and especially preferably less than 200% of the lift-roller diameter. If the lift rollers have different diameters, this information relates to the diameter of the lift roller with the larger diameter.

It is preferred that the two lift rollers are at respective spacings from the mesh belt and this spacing is preferably greater than 50% of the respective lift-roller diameter, in particular at least 55%, and most preferably at least 60% of the respective lift-roller diameter.

According to one embodiment of the invention, there are at least two, especially just two lift rollers relative to the mesh belt with the same third spacing or substantially situated at the same third spacing. The spacing between the axis of rotation of the lift roller and the mesh belt is the same or essentially the same. But it is also within the scope of the invention that the lift rollers are at different spacings $D_1$ and $D_2$ from the mesh belt, in which case the third spacing of the first lift roller to the mesh belt is larger than that third spacing of the second lift roller to the mesh belt. Hence the diameters ($d_1$ and $d_2$) of the two lift rollers and the spacings (D1 and D2) of these lift rollers from the mesh belt 3 within the scope of the invention must satisfy the equation:

$$D_1+d_1>D_2-d_2.$$

It is therefore preferred that the sum of $D_1$ and $d_1$ is greater than is the difference between $D_2$ and $d_2$.

It is within the scope of the invention that the nonwoven web passes over the lift roller. If according to a preferred embodiment of the apparatus according to the invention there are at least two lift rollers, in particular exactly two lift rollers, the nonwoven web is advantageously under the second lift roller and over the first lift roller. It is preferred in this context that the second lift roller be upstream in the travel direction of the mesh belt of the first lift roller. If the nonwoven web according to a preferred embodiment passes under the second lift roller and over the first lift roller, this first lift roller in particular is responsible for the separation of the nonwoven web from the mesh belt and the second lift roller is then is responsible for holding down the nonwoven web near the mesh belt. This embodiment is based on the discovery that the second lift roller that holds down the nonwoven web can move the separation location toward the second lift roller. That way the first spacing from the nose roller can be further limited, so that it is in particular a maximum of 25%, preferably a maximum of 10%, preferably a maximum of 5%, particularly preferably a maximum of 2.5% of that second spacing, very particularly preferably a maximum of 1%, for example 0.1% of the second spacing. Using two lift rollers, with a first lift roller for the removal process and a second lift roller for holding down, is also based on the knowledge that position of the separation location or line is reliably set by the second lift roller. Here in particular the third spacing $D_2$ of the second lift roller from the mesh belt exerts a decisive influence on the first spacing of the separation location or the separation line from the nose roller. In particular the ratio of the third spacing $D_1$ of the first lift roller to the mesh belt to the third spacing $D_2$ of the second lift roller to the mesh belt ($D_1/D_2$) is determines the position of the separation location or line in such a way that with larger wrap angle of the nonwoven web around the second lift roller the separation location or the separation line moves closer to the intersection of a straight line perpendicular to the mesh belt 3 through the center of the second lift roller. It is within the scope of the invention that the separation location or line be close to the second lift roller and in particular below the second lift roller.

If, according to a preferred embodiment of the invention, at least two lift rollers, in particular two lift rollers, are provided, it is within the scope of the invention that both lift rollers are adjustable vertically with respect to the mesh belt, and in addition are preferably movable vertically. It is possible that both lift rollers can move back and forth between a starting position and a lift position or into different lift positions. In the operating state of the apparatus, the two lift rollers are preferably in their lift positions. In principle the apparatus may be operated with the lift rollers in their starting position so long as separation of the nonwoven webs by the lift rollers is not necessary. It is recommended that the first lift roller is in its starting position below the deposition mesh belt and/or that the second lift roller is in its starting position above the deposition mesh belt. In principle, both lift rollers can be below or above the deposition mesh belt in their starting positions.

It is basically within the scope of the invention that the mesh belt or the transfer table when the apparatus is running is parallel or essentially parallel to the base of the apparatus or to the ground. A particularly preferred embodiment of the invention is that the nose roller can be moved or lowered vertically. The nose roller is preferably vertically movable or lowerable relative so the mesh belt extending between the deflection roller and the nose roller in travel direction is oriented relative to the base of the apparatus or ground and preferably at a downward slope of greater than 0° to 20°, in particular from 3° to 20°, preferably from 4° to 18°, especially preferably from 5° to 16°. For the mesh belt to have this downward slope toward the base of the apparatus it must advantageously be deflected at the deflection roller from its previous position with its travel direction running parallel to the base surface. The movability of the nose roller vertically is in particular a mobility of the nose roller upward and downward.

Another preferred embodiment of the invention device is characterized in that the nose roller can be moved or telescoped horizontally. In this context, the base of the apparatus is horizontal. Such horizontal movability or telescoping of the nose roller can move the nose roller for example closer to the downstream treatment device. Furthermore, the second spacing between the nose roller and the deflection roller is advantageously enlarged when moving or telescoping and reduced when the nose roller is retracted. Especially in a preferred embodiment, the nose roller is horizontally movable or telescopic and vertically movable or lowerable. This embodiment is based on the discovery that various positions of the nose roller can be adjusted. For example, the mesh belt can be moved downward while at the same time the nose roller can be moved closer to the downstream treatment device. When the nose roller has already been moved or lowered vertically, its horizontal movability or telescoping ability preferably also allow movement of the nose roller telescopically in the travel direction of the mesh belt, that is, according to the set slope of the mesh belt or the transfer table between the deflection roller and the nose roller.

If according to a particularly preferred embodiment of the invention the nose roller can be moved or telescoped horizontally and can be lowered or moved vertically and also the lift roller or the lift rollers can be moved vertically, different positions of the nose roller can be set and the lift rollers can be arranged in their lift positions such that the above-described spacings between the rollers with one below the other and the separated from the nose roller will be realized. These spacings and positions relate thus to the operating state of the device.

It is within the scope of the invention that the spacing of the separation location from the nose roller is also adjustable by the vertical and/or the horizontal movability or telescoping of the nose roller.

According to one embodiment of the apparatus according to the invention the nose roller can only be moved horizontally or telescopic and cannot be moved vertically. Here, the mesh belt is parallel or essentially parallel to the device base or to the ground and the nose roller can be moved or telescoped horizontally. According to a further embodiment of the apparatus according to the invention the nose roller can neither be moved vertically nor horizontally, that it is as if a rigid mesh belt is present that is parallel or substantially parallel to the device base or the ground. It is within the scope of these embodiments as described above possible that the device does not have a deflection roller. According to a preferred embodiment of the invention, the first spacing between the separation location or line and the nose roller is smaller than the fourth spacing between the nose roller and the deposition location of the mesh belt. The fourth spacing is measured within the scope of the invention in particular between a projection of the axis of rotation of the nose roller on the mesh belt and the deposition location, especially the middle of the deposition location, the projection of the axis of rotation of the nose roller being perpendicular to the longitudinal extension of the mesh belt in the area of the fourth spacing. It is preferred that the first spacing is a maximum of 50%, preferably a maximum of 25%, preferably a maximum of 10%, particularly preferably a maximum of 5%, very particularly preferably a maximum 2.5%, for example 1% of the fourth spacing. The fourth spacing appropriately refers to a state of device in which the mesh belt is parallel or essentially parallel to the device base or is the ground and in particular to an embodiment in which the device does not have a deflection roller and/or in which the nose roller is not vertically or horizontally movable or telescopic.

An embodiment that is very special within the scope of the invention is characterized by the fact that the downstream treatment device is a consolidator, in particular a hot-air bonder, for example an oven, and/or a calender and/or that the downstream treatment device is a winder. It is possible that the device has at least two downstream treatment devices, for example a consolidator, in particular a calender and a winder. Advantageously, in the travel direction of the nonwoven web the consolidator or the calender is upstream of the winder. The consolidator or the calender is used in particular for consolidation or final consolidation of the nonwoven web. After separation at the separation location the nonwoven web is advantageously transferred to the consolidator or calender.

It is within the scope of the invention that the consolidator or the calender is at least one calender roll, in particular at least one pair of calender rolls of which at least one calender roll preferably in can be moved vertically. The nonwoven web is in particular fed through the gap or nip between the at least two calender rolls preferably arranged one above the other. The nonwoven web can either be guided in such a way that it does not touch either of the calender rolls because the calender or at least one calender roller pair is open or pass in such a way or that one of the calender rolls is touched, so the properties of the corresponding side of the nonwoven web can be affected or it can be guided in such a way that forth faces touch the calender rolls touched because the calender or at least one calender roller pair is closed. It is still in the scope of the invention that the nonwoven web when passing between the both calender rolls is consolidated in particular by thermal bonding. Particularly preferred for the consolidator or for the calender is at least three calender rolls of which preferably at least one calender roll is movable vertically and the at least three calender rolls are oriented one above the other. This arrangement results in two calender roll pairs, one formed by the top calender roll and the middle calender roll and the other by the bottom calender roll and the middle calender roll. The nonwoven web is consolidated by passing through one of the nips. It is in this context in within the scope of the invention that the position of the nose roller and/or the lift rollers is adjustable as a function of the operating mode of the calender. The consolidator or the calender has recommended dimensions forming at least one consolidation zone where the nonwoven web is consolidated or finally consolidated. The consolidation zone is in this context where the nonwoven web interacts with or contacts at least one calender roll and is thereby consolidated or final consolidated or otherwise treated. It is recommended that the consolidation zone of the consolidator or the calender is above the nose roller and/or the mesh belt. This position of the consolidation zone refers to the use position or the operating state of the device.

It is within the scope of the invention that the calender is a consolidation calender and/or a coating calender and/or a calibration calender and/or a lamination calender and/or a activation calender.

It is recommended that the nonwoven web be separated from the mesh belt after preconsolidation of the nonwoven web. The nonwoven web is therefore preconsolidated before separation from the mesh belt. To this end, the apparatus advantageously has a preconsolidator that is upstream in the travel direction of the separation location of the mesh belt. It is possible to separate the nonwoven web from the mesh belt prior to final consolidation of the nonwoven web. In principle, however, it is also possible that the device is set up such that the final consolidation of the nonwoven web is effected before the nonwoven web is separated from it the mesh belt. Such an embodiment in which the final consolidation of the nonwoven web is done before the nonwoven web is separated from the mesh belt is particularly preferred if the nonwoven web directly is transferred to a coating calender and/or a calibration calender and/or a lamination calender and/or an activation calender and/or a hot-air bonders, for example an oven.

It is also within the scope of the invention that the downstream lift roller and/or the second lift roller are offset from the nose roller by a roller spacing that is at least 50% of the diameter of the respective lift roller. This spacing becomes is advantageously measured between the projections of the axes of rotation of the lift roller and the nose roller on the mesh belt, the projections of the axes of rotation being perpendicular to the longitudinal extension of the mesh belt or to the imaginary extension of this longitudinal extension in the area of this roller spacing. If according to the preferred embodiment, at least two, in particular just two lift rollers are provided, they preferably have respective roller spacings from the nose roller, which are each at least 50% of the diameter of each lift roller.

The invention also proposes attaining the inventive object with a method of transporting and treating a nonwoven web made of continuous filaments, in particular with the above-described device, where the nonwoven web passes at a deflection zone over and around a nose roller deflecting the mesh belt from the travel direction of the nonwoven web, and the nonwoven web is then transferred to a downstream device, the nonwoven web being separated from at the deflection zone. The method according to the invention is characterized in that the nonwoven web is guided for separation from the mesh belt over at least one lift roller above the mesh belt, and the nonwoven web is separated from the mesh belt by at least one lift roller at a separation location that is set at a first spacing from the nose roller and the nonwoven web is then fed to the downstream treatment device.

According to a preferred embodiment, in the downstream treatment device or devices the nonwoven web is wound and/or coated and/or calibrated and/or activated and/or consolidated.

The invention is based on the discovery that with the apparatus according to the invention a functionally reliable and simple separation of the nonwoven web from the mesh belt is possible and that in particular the force required to separate the nonwoven web can be reduced compared to known measures. This separation of the nonwoven web is effected by at least one lift roller in a separation location offset in the travel direction of the mesh belt upstream of the deflection zone. The nonwoven web can be separated by the measures according to the invention, in particular without damaging the nonwoven web for example by tearing out filaments so that there no unwanted filament residues remain on the mesh belt. It should also be emphasized that the measures according to the invention are relatively simple and can be taken without significant effort or expense. If according to a preferred embodiment of the invention at least two, in particular exactly two lift rollers, are provided, the separation location or line and thus the first spacing from the nose roller is set very precisely. The preferred vertical mobility of the lift roller or rollers and/or to the horizontal movability or telescoping of the nose roller and/or the vertical movability of the nose roller can set different operating parameters of the apparatus and in particular, the spacing between the nose roller and a downstream treatment device, for example to a calender, set and/or a slope of the mesh belt can be set and the lift roller or rollers can be orient relative to the mesh belt such that the separation of the nonwoven web at the separation or line takes place or can take place upstream of the deflection zone. The apparatus according to the invention or the method according to the invention can therefore be used very flexibly, with the various use positions each ensuring a simple and functionally reliable separation of the nonwoven web from the mesh belt with relatively little effort and that can be done in particular without damaging the nonwoven web.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
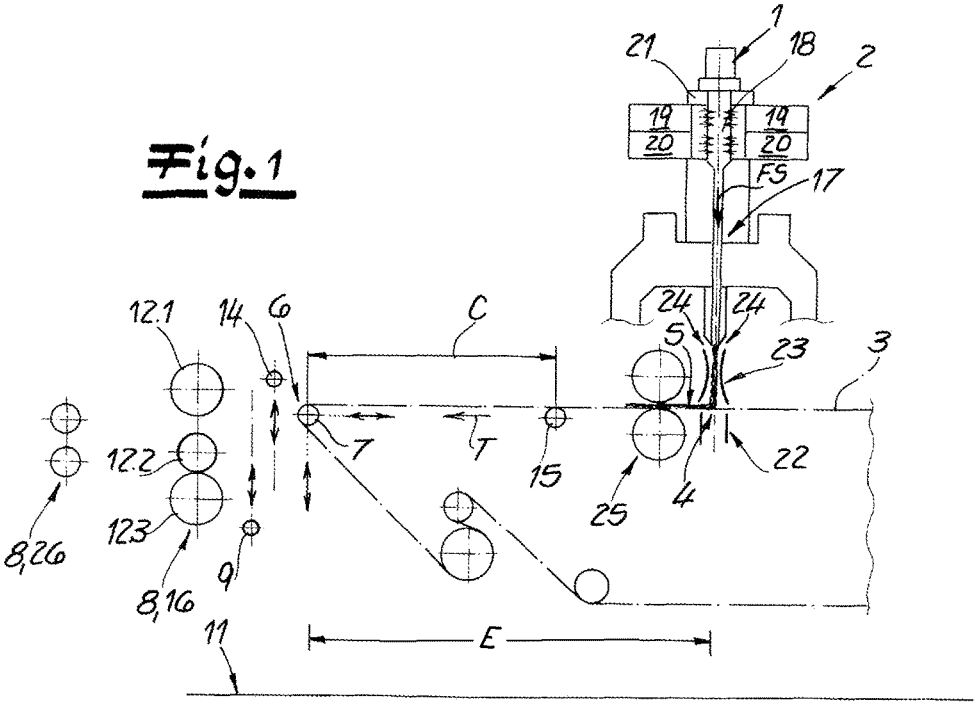
FIG. 1 is a schematic vertical section through an apparatus according to the invention with two lift rollers in their starting positions.

As seen in FIG. 1 an apparatus for making nonwoven from continuous filaments has a spinner formed by a spinneret 1 serving for spinning the filaments and a cooler 2 for cooling the filaments. Furthermore, a mesh belt 3 is provided on which the filaments can be deposited in a deposition location 4 of the nonwoven web 5. Appropriately and here according to the drawing, if the device is a spunbond device, it has a stretcher 17 for stretching the filaments. The continuous filaments can be monocomponent filaments made of at least one thermoplastic resin. The cooler 2 preferably and here has a cooling chamber 18 through which the continuous filaments pass. Preferably and here, upper and lower cooling compartments 19 and 20 flank the cooling chamber 18 on top of each other and feed air of different temperatures into the cooling chamber 18. Also preferably and here, between the spinner 1 and the cooler 2 there is a monomer aspirator or suction device 21 that withdraws noxious gases created by the spinning process from the apparatus. The noxious gases can for example be monomers or oligomers and the like.

Appropriately and here the cooler 2 downstream in the filament-travel direction FS is the downstream stretcher 17 for stretching the filaments. According to the highly recommended embodiment and here the subassembly formed by the cooler 2 and the stretcher 17 is a closed subassembly, where apart from the supply of cooling air in the cooler 2 there is no further air supply into the closed subassembly.

In the context of the invention and here between the stretcher 17 and the mesh belt 3 there is a diffuser 23 through which the continuous filaments pass. According to a recommended embodiment and here there is a secondary air inlet gap 24 for the introduction of secondary air into the diffuser 23 between the stretcher 17 and the diffuser 23. After passing through the diffuser 23, the continuous filaments are deposited on the mesh belt 3 in the area 4 of the nonwoven web 5 and then moved away by the mesh belt 3 in a travel direction T of the mesh belt 3. There is under the mesh belt 3 an aspirator 22 for extracting air or process air through the mesh belt 3.

According to the invention, the mesh belt 3 passes at one deflection zone 6 around at least one nose roller 7 and is thereby deflected from its travel direction T. The nose roller 7 is spaced downstream of the deposition location 4 by a fourth spacing E. When the apparatus is running (FIGS. 2 to 4), the nonwoven web 5 is separated upstream of the deflection zone 6 from the mesh belt 3 and can then be transferred to at least one downstream treatment device 8. Here there are two downstream treatment devices 8: a calender 16 and a winder 26.

In order to separate the nonwoven web 5 from the mesh belt 3, there are preferably and here according to the drawing two lift rollers 9 and 14. Recommended and here the lift rollers 9 and 14 can move vertically relative to the mesh belt 3. This can be seen in particular in FIG. 1. The lift rollers 9 and 14 are advantageously height adjustable or vertically displaceable between respective starting positions and respective lift positions. The starting positions of the lift rollers 9 and 14 as shown in FIG. 1 allow cleaning of the apparatus according to the invention and/or insertion of the nonwoven web when the apparatus is not running. Different lift positions of the rollers 9 and 14 are shown in FIG. 3 where the apparatus is running. In the use or lift position, the lift rollers 9 and 14 are above the mesh belt 3 and the nonwoven web 5 are separated by the lift rollers 9 and 14 from the mesh belt 3 at a separation location or line 10 that is set at a first spacing A upstream of the nose roller 7. The first spacing A between the nose roller 7 and the separation location or line 10 is in particular the spacing A between the axis of rotation of the nose roller 7 and the separation location or line 10. The first spacing A is between a projection of the axis of rotation of the nose roller 7 on the mesh belt 3 and the separation location or line 10, the projection of the axis of rotation being perpendicular to the longitudinal extension of the mesh belt 3 and falling in the area of the first spacing A (FIGS. 2 to 4).

Figure 2:
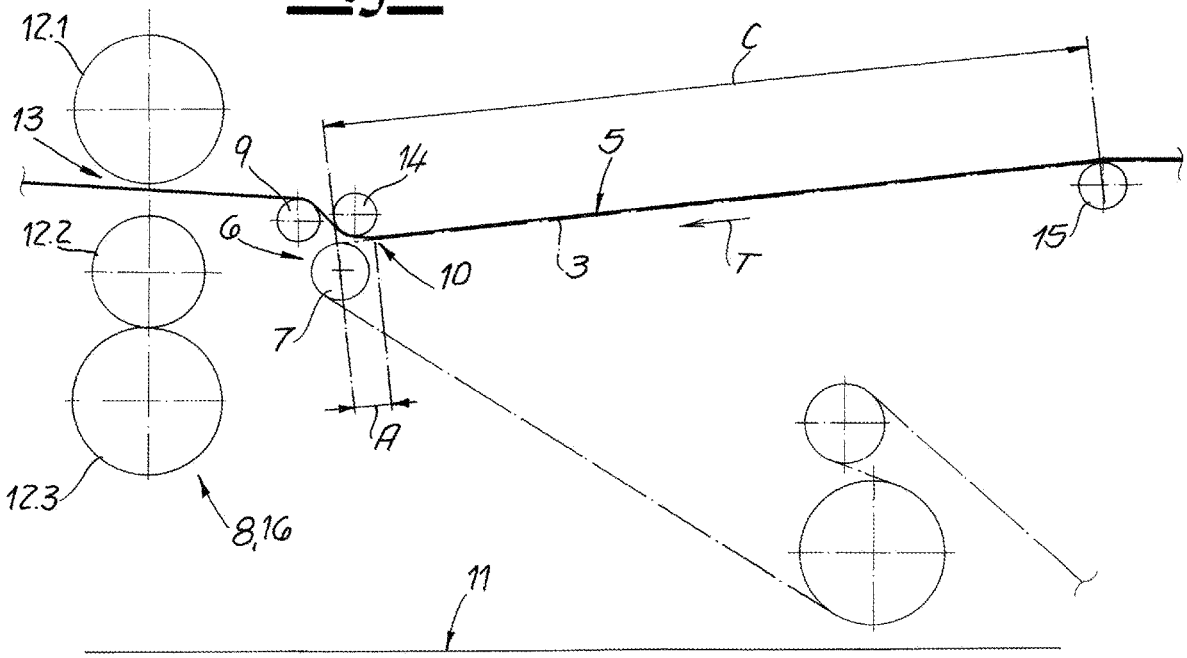
FIG. 2 shows the apparatus of FIG. 1 in a first operating or use position.
Figure 3:
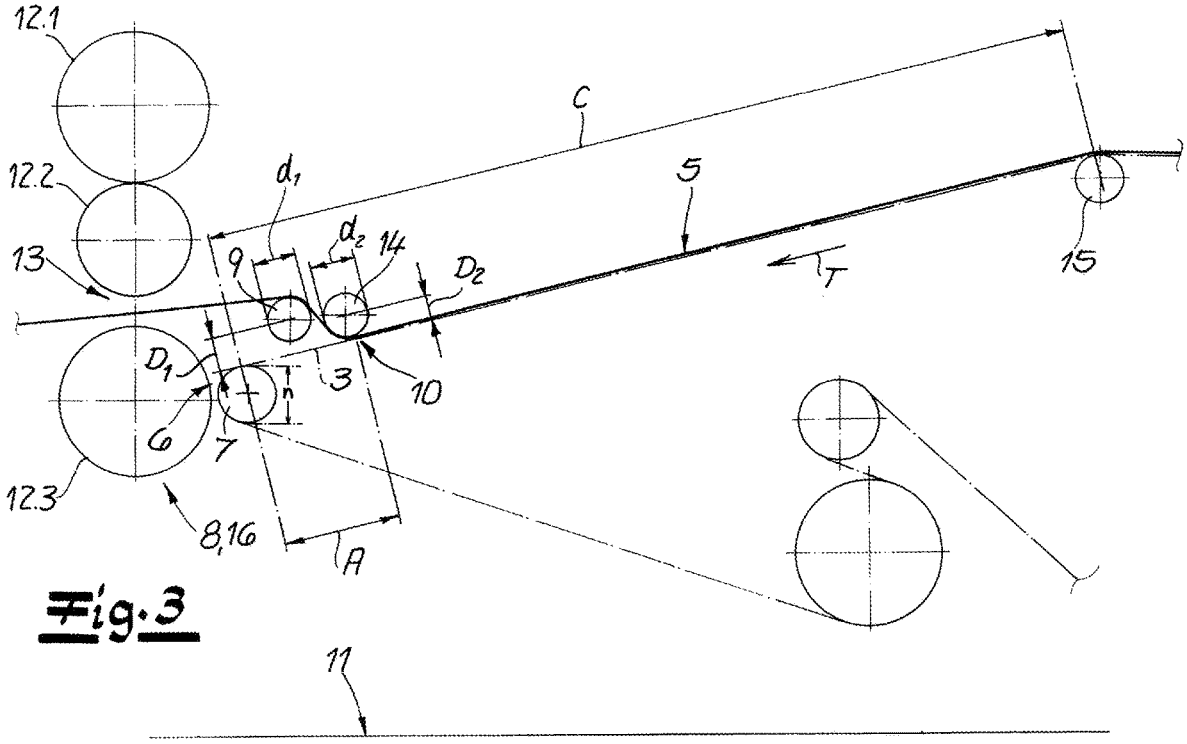
FIG. 3 shows the apparatus according to FIG. 1 in a second operating or use position.
Figure 4:
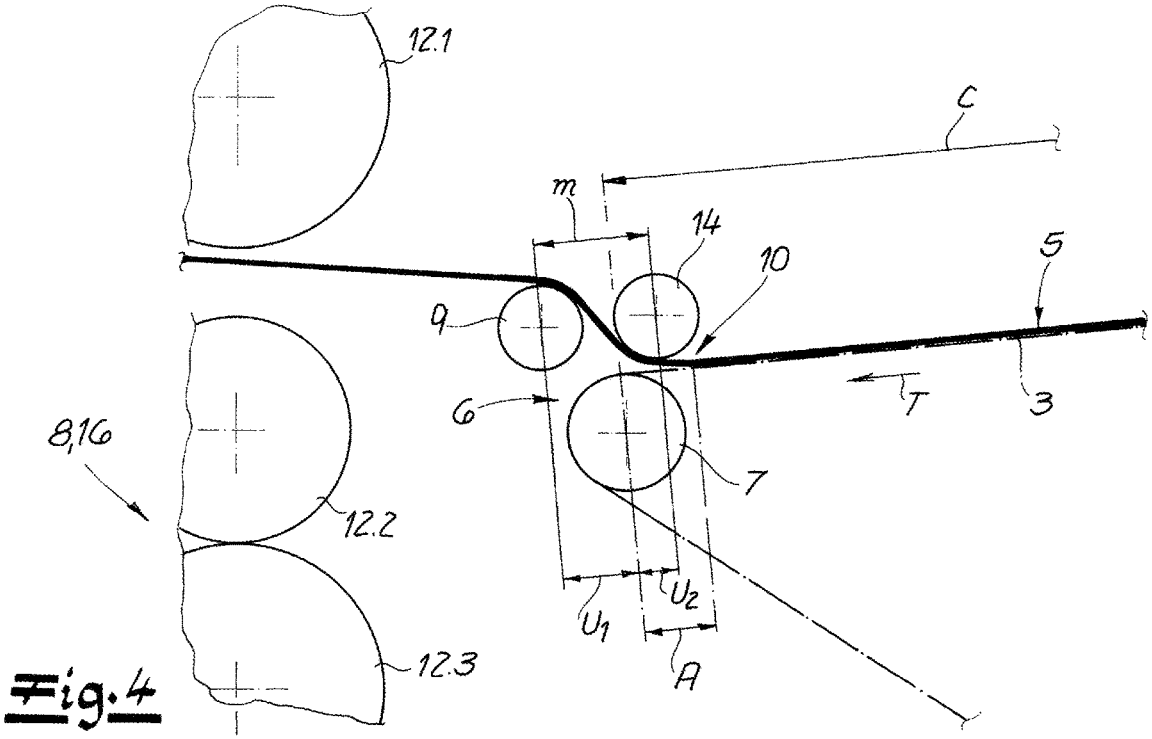
FIG. 4 is an enlarged view of the nose roller and the lift rollers of the device in the use position of FIG. 2.

Recommended and here according to the drawing when the apparatus is running, the lift roller 9 is upstream in the travel direction T of the mesh belt 3 of the nose roller 7 (FIG. 2 or 3). The other lift roller 14 is preferably upstream in the travel direction T of the mesh belt 3 of the downstream roller 9.

According to a particularly preferred embodiment of the invention the first spacing A is smaller than the second spacing C here between the downstream nose roller 7 and an upstream deflection roller 15. This upstream deflection roller 15 serves with the downstream nose roller 7 for movement of the mesh belt 3 in the travel direction T of the mesh belt 3 upstream of the nose roller 7. The deflection roller 15 is in this embodiment between the deposition location 4 and the deflection zone 6. The mesh belt 3 is either deflected at the roller 15 from its travel direction (FIG. 1) or passes in its travel direction straight past it (FIGS. 2 and 3) as explained in more detail below.

The second spacing C between the nose roller 7 and the deflection roller 15 is in the context of the invention in particular the spacing between the axes of rotation of the nose roller 7 and the deflection roller 15, or between projections of the axes of rotation the mesh belt 3 perpendicular to the longitudinal extension of the mesh belt 3 in the area of the second spacing C. It is recommended that the first spacing A be a maximum of 30%, preferably a maximum of 20% of the second spacing C. Here according to FIG. 2, the spacing A may be about 5% of the second spacing C. Here according to FIG. 3, the first spacing A may be about 15% of the second spacing C.

The lift rollers 9 and 14 here rotate about their axes. Diameters $d_1$ and $d_2$ of the lift rollers 9 and 14 are preferably 25 to 400 mm, especially preferably 100 to 250 mm. In the context of the invention and here the downstream lift roller 9 and the upstream lift roller 14 have the same or substantially the same diameter $d_1$ or $d_2$. Particularly preferred and in this embodiment (in particular FIG. 4) a spacing m between the axes of rotation of the two lift rollers 9 and 14 when the apparatus is running is at least 115% of the diameters $d_1$ or $d_2$ of the lift rollers 9 and 14. Here according to the drawing the spacing m between the axes of rotation of the two lift rollers 9 and 14 is about 130% of the diameter $d_1$ or $d_2$ of either of the lift rollers 9 and 14. In this context, the rotation-axis spacing m is in particular the spacing between the axes of rotation of the two lift rollers 9 and 14, where this rotation-axis spacing m is advantageously between projections perpendicular to the longitudinal extension of the mesh belt 3 or to the imaginary extension of this longitudinal extension of the axes of rotation of the lift rollers 9 and 14 on the mesh belt 3.

Appropriately and here the lift rollers 9 and 14 are set relative to the mesh belt 3 at a mutual third spacing. This third spacing is in this context in particular the spacing between the axes of rotation of the respective lift rollers 9 and 14 parallel to the mesh belt 3. The third spacing to the mesh belt 3 is advantageously perpendicular to the longitudinal extension of the mesh belt 3 in the area of lift rollers 9 and 14 or to the imaginary extension of these longitudinal extension. In the example according to the drawing (in particular FIG. 3) the spacing of the first lift roller 9 from the mesh belt 3 is shown at $D_1$ and the spacing of the second lift roller 14 from the mesh belt 3 at $D_2$. In the context of the invention and here the third spacing or the spacings $D_1$ and $D_2$ are greater than 50% of either of the diameter $d_1$ or $d_2$ of the lift rollers 9 and 14.

Also preferably and here, (in particular FIG. 3) the third spacing $D_1$ of the first lift roller 9 from the mesh belt 3 is greater than the third spacing $D_2$ of the second lift roller 14 from the mesh belt 3. The nonwoven web 5 runs advantageously and here, when the apparatus is running, under the second lift roller 14 and then over the first lift roller 9. This is shown in particular in FIGS. 2 to 4. The first lift roller 9 is preferably used for separating the nonwoven web 5 of the mesh belt 3. The second lift roller 14 serves for holding down the nonwoven web 5 on the mesh belt 3. The separation location 10 or line is thus advantageously and here near the second lift roller 14 and in particular below the second lift roller 14.

According to the a preferred embodiment and here the nose roller 7 can be raised and lowered vertically to move the mesh belt 3 between the deflection roller 15 and the nose roller 7 in the travel direction T relative to a horizontal base 11 of the apparatus. Appropriately and here, the mesh belt in this area has a downward incline of 3° to 20°. Here according to FIG. 2 the downward incline is about 7° and according to FIG. 3 about 15°. the deflection roller 15 thus deflects the mesh belt 3 from its previous position with the travel direction T (FIGS. 2 and 3) running parallel to the device base 11. The movability of the nose roller 7 vertically in this connection is relative to the device base 11. Further preferably and here, the nose roller 7 is and can be moved or telescoped horizontally. "Horizontal" in this context is parallel to the device base 11. The horizontal movability or telescoping of the nose roller 7 entails movement this nose roller 7, for example, closer to the downstream treatment device 8 or the calender 16. Particularly preferably and here, the nose roller 7 is horizontally movable or telescopic and vertically movable, so that a wide variety of positions of the nose roller can be assumed. If according to a preferred embodiment and here the nose roller 7 can be moved or telescoped horizontally and can be shifted vertically, and in addition the lift rollers 9 and 14 can move vertically, different positions of the nose roller 7 can be set and the lift rollers 9 and 14 can be set in their lift positions such that in particular the first spacing A of the separation location 10 from the nose roller 7 when the apparatus is running can be set.

Within the scope of the invention and here, the downstream treatment device 8 is a calender 16. The embodiment according to FIG. 1 has downstream in the travel direction therefrom the treatment device 8 in the form of a winder 26. Here according to the drawing, the calender 16 has three adjustable vertically calender rolls 12.1, 12.2 and 12.3. The nonwoven web 5 passes through a gap or nip between two of the calender rolls 12.1, 12.2, 12.3. The three calender rolls 12.1, 12.2, 12.3 are advantageously one above the other here. This creates two pairs of calender rolls, namely one between the top calender roll 12.1 and the middle calender roll 12.2 and another between the lowermost calender roll 12.3 and the middle calender roll 12.2. The nonwoven web 5 is consolidated or final consolidated here in consolidation zones 13 between the calender rolls 12.1, 12.2, 12.3. Such consolidation zones 13 of the calender 16 can consolidate or finally consolidate the nonwoven web 5. The consolidation zone 13 in this context is the area where at least one calender roll 12.1, 12.2, 12.3 can consolidated or finally consolidate the nonwoven web 5 by the action of the calender 16. As part of the invention and here according to FIGS. 2 to 4 the consolidation zone 13 of the calender 16 when the apparatus is running is above the nose roller 7 and arranged above the mesh belt 3.

Further preferably and here, according to the drawing the separation of the nonwoven web 5 from the mesh belt 3 takes place after preconsolidation of the nonwoven web 5. The nonwoven web is thus as recommended and in the example preconsolidated upstream of the separation line 1 on the mesh belt 3 by a preconsolidator 25. This can be seen in particular in FIG. 1.

It is also within the scope of the invention that the first lift roller 9 and/or the second lift roller 14 are offset from the nose roller 7 by respective spacing $U_1$ and $U_2$ that together are at least 50% of the diameter of the respective lift rollers 9 and 14. These spacings $U_1$ and $U_2$ in this context are in particular the spacings between the axes of rotation of the respective lift rollers 9 and 14 and the axis of rotation of the nose roller 7, the spacing $U_1$ and $U_2$ advantageously between the projections of the axes of rotation of the lift rollers 9 and 14 and the nose roller 7 parallel to the mesh belt 3, the projections of the axes of rotation perpendicular to the longitudinal extension of the mesh belt 3 or to the imaginary extension of this longitudinal extension is in the region of the spacings $U_1$ and $U_2$. In this embodiment according to the drawing the lift rollers 9 and 14 have respective center-to-center spacings $U_1$ and $U_2$ from the axis of the nose roller 7, which is at least 50% of the diameter $d_1$ or $d_2$ of the larger of the lift rollers 9 and 14 (FIG. 4).

We claim:

1. An apparatus for making nonwoven from continuous filaments, the apparatus comprising a spinner for spinning the filaments;

a cooler for cooling the spun filaments;

a mesh belt that moves in a generally horizontal travel direction and that passes through a deposition location where the spun and cooled filaments are deposited on the mesh belt to form thereon a nonwoven web;

a nose roller defining a deflection zone over which the mesh belt is deflected from its travel direction;

at least one lift roller above the mesh belt downstream of the deposition location and adjustable vertically relative to the mesh belt for separating the nonwoven web from the mesh belt at a separation location at a first spacing upstream from the deflection zone of the nose roller; and a treatment device for the nonwoven web downstream of the mesh belt in the travel direction and receiving the nonwoven web from the lift roller.

2. The apparatus according to claim 1, wherein the lift roller is set or positionable relative to the nose roller such that the separation location is spaced or orientable in the travel direction of the mesh belt upstream of the deflection zone, the lift roller being upstream or downstream of the nose roller in the travel direction of the mesh belt.

3. The apparatus according to claim 1, further comprising:

a deflection roller supporting the mesh belt, offset by a second spacing upstream of the nose roller, and upstream of the deposition location, the first spacing being a maximum of 50% of the second spacing.

4. The apparatus according to claim 1, wherein the lift roller is rotatable and driven.

5. An apparatus for making nonwoven from continuous filaments, the apparatus comprising a spinner for spinning the filaments;

a cooler for cooling the spun filaments;

a mesh belt that moves in a generally horizontal travel direction and that passes through a deposition location where the spun and cooled filaments are deposited on the mesh belt to form thereon a nonwoven web;

a nose roller defining a deflection zone over which the mesh belt is deflected from its travel direction;

at least one lift roller above the mesh belt downstream of the deposition location and at or settable at a third spacing from the mesh belt, the and this third spacing is greater than 50% of a diameter of the lift roller for separating the nonwoven web from the mesh belt at a separation location at a first spacing upstream from the deflection zone of the nose roller; and a treatment device for the nonwoven web downstream of the mesh belt in the travel direction and receiving the nonwoven web from the lift roller.

6. The apparatus according to claim 5, wherein the diameter of the lift roller is 10 to 500 mm.

7. An apparatus for making nonwoven from continuous filaments, the apparatus comprising a spinner for spinning the filaments;

a cooler for cooling the spun filaments;

a mesh belt that moves in a generally horizontal travel direction and that passes through a deposition location where the spun and cooled filaments are deposited on the mesh belt to form thereon a nonwoven web;

a nose roller defining a deflection zone over which the mesh belt is deflected from its travel direction;

at least one first lift roller above the mesh belt downstream of the deposition location for separating the nonwoven web from the mesh belt at a separation location at a first spacing upstream from the deflection zone of the nose roller;

a treatment device for the nonwoven web downstream of the mesh belt in the travel direction and receiving the nonwoven web from the lift roller; and a second lift roller in addition to the first lift roller and between the first lift roller and the deposition location.

8. The apparatus according to claim 7, wherein the first lift roller and the second lift roller have the same or substantially the same diameter and a fourth spacing between the axes of rotation of the two lift rollers is at least 105% of the lift-roll diameter.

9. The apparatus according to claim 7, wherein the nonwoven web passes under the second lift roller and over the first lift roller.

10. The apparatus according to claim 3, wherein the nose roller is movable or positionable vertically to angle the mesh belt at least between the deflection roller and the nose roller in the travel direction toward the device base at a downward slope from 3° to 20°.

11. The apparatus according to claim 10, wherein the nose roller is moved horizontally movable or extensible.

12. The apparatus according to claim 10, wherein the first spacing of the separation location from the nose roller is adjusted by the vertical movability and/or the horizontal movability or telescoping of the nose roller.

13. The apparatus according to claim 1, wherein the treatment device is a consolidator, a calender, or a winder.

14. The apparatus of claim 13, wherein the calender has a pair of calender rolls of which at least one is movable vertically.

15. The apparatus according to claim 1, wherein separation of the nonwoven web from the mesh belt takes place after preconsolidation of the nonwoven web.

16. An apparatus for making nonwoven from continuous filaments, the apparatus comprising a spinner for spinning the filaments;

a cooler for cooling the spun filaments;

a mesh belt that moves in a generally horizontal travel direction and that passes through a deposition location where the spun and cooled filaments are deposited on the mesh belt to form thereon a nonwoven web;

a nose roller defining a deflection zone over which the mesh belt is deflected from its travel direction;

at least one lift roller above the mesh belt downstream of the deposition location and a fifth spacing upstream from the nose roller that is at least 50% of the diameter of the lift roller for separating the nonwoven web from the mesh belt at a separation location at a first spacing upstream from the deflection zone of the nose roller; and a treatment device for the nonwoven web downstream of the mesh belt in the travel direction and receiving the nonwoven web from the lift roller.

17. A method of making nonwoven, the method comprising the steps of:

spinning continuous filaments;

cooling the spun filaments;

moving a mesh belt in a generally horizontal travel direction through a deposition location and there depositing the cooled filaments on the mesh belt to form thereon a nonwoven web moving in the direction with the belt;

deflecting the belt from its travel direction over a nose roller in a deflection zone downstream of the deposition location;

passing the nonwoven web over a lift roller and thereby separating the nonwoven web from the mesh belt at a separation zone where the nonwoven web deviates from the travel direction;

vertically adjusting a position of the lift roller relative to the mesh belt;

orienting the lift roller to position the separation location at a spacing upstream from the nose roller; and, passing the nonwoven web from the lift roller to a downstream device.

* * * * *